US007766761B2

(12) United States Patent
Cayse

(10) Patent No.: US 7,766,761 B2
(45) Date of Patent: Aug. 3, 2010

(54) GOLF SWING TRAINING APPARATUS

(76) Inventor: Raymond T. Cayse, 20428 Califa St., Woodland Hills, CA (US) 91367

( * ) Notice: Subject to any disclaimer, the term of this patent is extended or adjusted under 35 U.S.C. 154(b) by 0 days.

(21) Appl. No.: 12/387,833

(22) Filed: May 7, 2009

(65) Prior Publication Data

US 2009/0325724 A1 Dec. 31, 2009

Related U.S. Application Data

(63) Continuation-in-part of application No. 12/009,306, filed on Jan. 16, 2008, now abandoned.

(51) Int. Cl.
*A63B 69/36* (2006.01)

(52) U.S. Cl. ..... 473/229; 473/257

(58) Field of Classification Search ..... 473/219, 473/226, 228, 229, 256, 257
See application file for complete search history.

(56) References Cited

U.S. PATENT DOCUMENTS

| | | | | | |
|---|---|---|---|---|---|
| 612,173 | A | * | 10/1898 | Newton | 473/576 |
| 2,408,160 | A | * | 9/1946 | Brunner | 273/440 |
| 3,606,340 | A | * | 9/1971 | Tiller | 473/232 |
| 4,576,378 | A | * | 3/1986 | Backus | 473/228 |
| 5,184,825 | A | * | 2/1993 | Ruth | 473/228 |
| 5,879,251 | A | * | 3/1999 | Rose | 473/576 |

* cited by examiner

*Primary Examiner*—Nini Legesse

(57) ABSTRACT

A golf swing training apparatus and method of using same that instructs a trainee in the two optimum golf swings, namely an inward swing and an outward swing. The apparatus of the invention is of a unique configuration that, through the use of a novel practice ball assembly, allows a trainee to positively observe the differences between the inward golf swing and the outward golf swing.

16 Claims, 13 Drawing Sheets

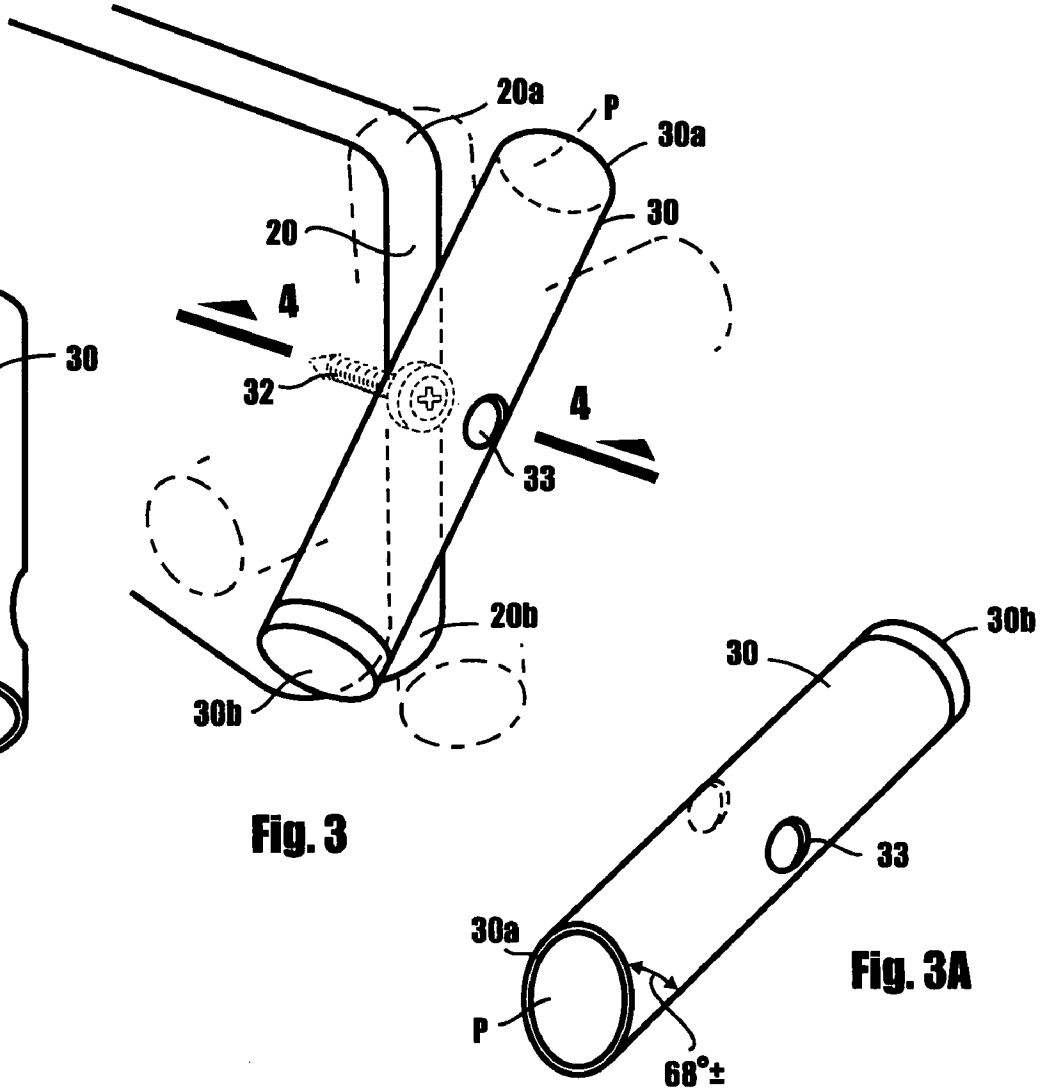
Fig. 3A
Fig. 3
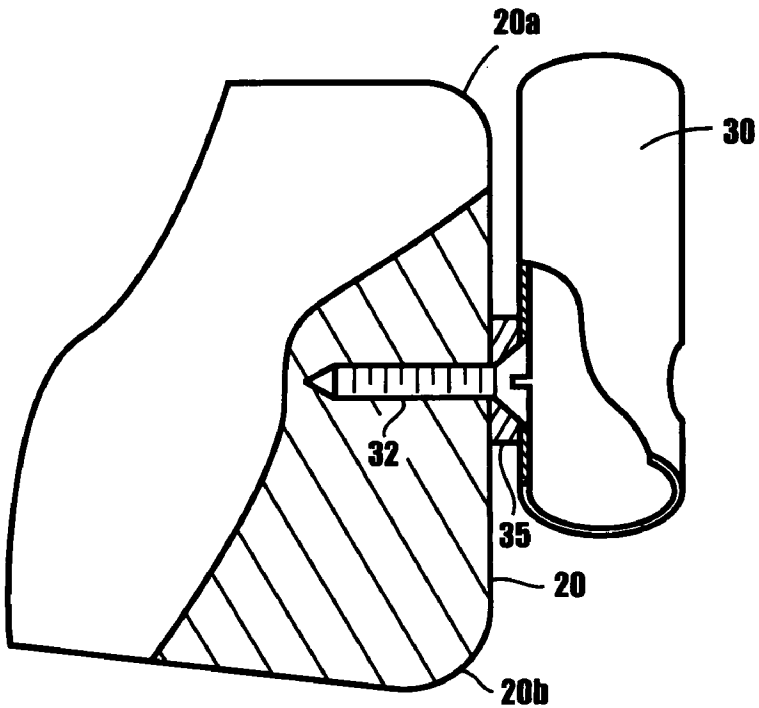
Fig. 4

76
77
74
78a
78
50a
15
60
62
63
60t
60b
60a
46
50
50b
16
45°
65
67
68°

GOLF SWING TRAINING APPARATUS

This is a Continuation-In-Part of co-pending U.S. application Ser. No. 12/009,306, filed Jan. 16, 2008 now abandoned.

BACKGROUND OF THE INVENTION

1. Field of the Invention

The present invention relates generally to golf swing training apparatus. More particularly, the invention concerns an apparatus for instructing a trainee in two golf swings, namely an inward swing and an outward swing.

2. Discussion of the Prior Art

It is generally agreed that there are two mutually exclusive and equally effective optimum golf swings, namely the so-called "inward" golf swing and the so-called "outward" golf swing. It is also generally agreed that the golf swing embodies two separate applications of geometry, both of which must be properly addressed in an effective golf swing. The first of these, namely "impact geometry", concerns the fact that one must compress the ball on the face of the club head in such a manner that maximum swing force is transferred.

Accomplishing this without side spin is the ideal, but most accomplished golfers use either a draw spin or a fade spin in carrying out the majority of their shots. The other application of geometry, namely "force controlling geometry", produces the physics that control the transfer of the total swing force to the club head. Most good golfers develop a feel for an effective swing through a trial and error method ("muscle memory") that is inconsistent at best. Adding to the difficulty with this approach is the fact that there are two diametrically opposed procedures for effectively releasing the club head, each with its own unique feel. Mostly because of this fact, contradictory advice has always plagued the game; more often by being incomplete, rather than totally wrong. The forgoing and various other theories concerning the golf swing have been discussed in numerous books and articles, including books by Ben Hogan and Homer Kelley.

Ben Hogan in his noted work, "Five Lessons: The Modern Fundamentals of Golf", likened the swing plane to a large flat pane of glass inclined from the intended line of flight of the ball and generally resting on the shoulders of the trainee. In Hogan's theory, the glass pane intersected the ground in a line which was coincident with the line of flight. To control club movement, the golfer ideally swung the club head underneath the plane throughout the swing. However, Hogan introduced a slight shift in the plane line in the downswing to account for the apparent motion of the club head outward and away from the golfer from hip height, through impact.

Homer Kelley, in his well known book, "The Golfing Machine", describes the swing plane as a two dimensional geometric structure on which the entire club moves throughout the golf swing. Kelley pictured the swing plane as a flat pane of glass intersecting the ground in a line with the plane line being identical with the intended initial line of flight of the ball. This plane was described by Kelley as having a dynamically changing inclined angle during the swing, with the entire club remaining on the plane throughout the swing. Kelley mentions in his book that depending on the number of accumulators used, that is to say, parts of his "power package", a golf swing can be anything from a simple "one barrel" to a full "four barrel" version.

The inward and outward swings, which are taught to be recognized by the trainee through the use of the apparatus of the present invention, can be explained in terms of the Kelley concepts as follows: Basically, there are five basic elements of the golf swing; the lower body (hips), the upper body (shoulders), the leading arm, the hands, and the shaft flex. These five elements are released in the sequence listed in the downswing of each swing method. However, each element has the potential to release in either direction, that is, inward or outward. As such, they have the capacity to create torque four times by opposing each other in sequential fashion. It is these four potential segments of torque that actually establish the number of barrels a swing contains and, thereby, its ability to create effortless power.

In performing the golf swing, each of the five basic elements of the golf swing element is indirectly affected by each of the others. For example, the hips are outward when they are adding to the turning force of the swing through impact and they are inward when they are resisting this force. The shoulders act similarly, but must act in an opposite direction to the hips for a four barrel swing to result. The leading arm is outward when the angle formed by it and the shoulders is increasing (Kelley's #4 accumulator); and it is inward when this angle is decreasing through impact. The action of the hands and club shaft are similar to the action of the hips and shoulders.

The importance of understanding and being able to recognize the two swing methods discussed in the preceding paragraphs is highlighted by the fact that, while most touring professionals are inward swingers there are some notable exceptions, including Jack Nicklaus, Greg Norman, Fred Couples and John Daly. Examples of renowned inward swingers include Arnold Palmer, Lee Trevino, Steve Elkington and Nick Faldo.

Teachers of golf and authors of books and articles on the golf swing almost always fall into one category or the other. For example, Ben Hogan's "Five Lessons, The Modern Fundamentals of Golf" tends to favor the inward swing, while Leslie King's "Master Key to Good Golf" tends to favor the outward swing.

SUMMARY OF THE INVENTION

It is an object of the invention to provide a training apparatus that instructs a trainee in the two optimum golf swings, namely an inward swing and an outward swing.

Another object of the invention is to provide an apparatus of the aforementioned character that allows a trainee to positively observe the differences between the inward golf swing and the outward golf swing.

Another object of the invention is to provide a training apparatus as described in the preceding paragraphs that is of a simple, compact construction and one that can be used by the trainee with a minimum of instruction.

BRIEF DESCRIPTION OF THE DRAWINGS

FIG. 3 is a greatly enlarged, generally perspective view of the area designated in FIG. 2 as 3-3.

FIG. 3A is a generally perspective view of one form of the practice ball assembly carrying components of the invention.

FIG. 4 is a cross-sectional view taken along lines 4-4 of FIG. 3.

DESCRIPTION OF THE INVENTION

Figure 1:
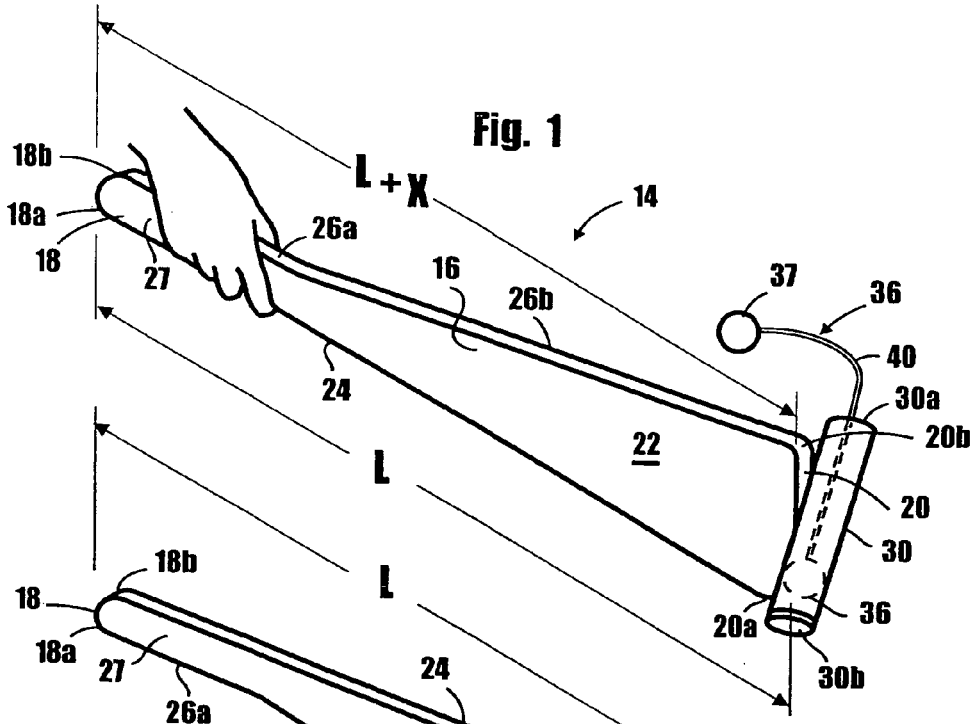
FIG. 1 is a generally perspective view of one form of the golf training apparatus of the invention for practicing the inward swing.
Figure 2:
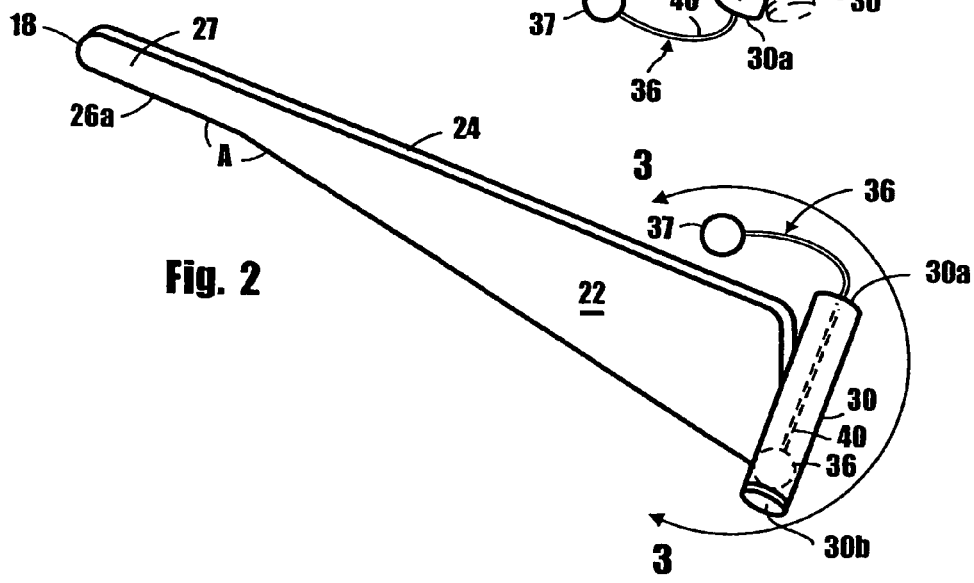
FIG. 2 is a generally perspective view similar to FIG. 2, but showing the practice ball assembly carrying component rotated 180 degrees.

Referring to the drawings and particularly to FIGS. 1, 3 and 4, one form of the golf training apparatus of the invention is there shown and generally identified by the numeral 14. This form of the apparatus comprises an elongated, substantially planar paddle component 16 having a first end 18, a second end 20, and a tapered body portion 22 disposed intermediate said first and second ends. As seen in FIG. 1, first end 18 has a first extremity 18*a* and a second extremity 18*b*. Similarly, second end 20, which is substantially longer than first-end 18, has a first extremity 20*a* and a second extremity 20*b*. Extremities 18*a* and 20*a* are interconnected by a generally straight first side 24, while extremities 18*b* and 20*b* are connected by a spaced apart second side 26. Second side 26 has a first segment 26*a* that extends substantially parallel to first side 24 and along with a portion of first side 24, defines a hand grip portion 27. Second side 26 also includes a second segment 26*b* that extends from said first segment at an obtuse angle "A" (FIG. 2) and interconnects the hand grip portion with extremity 20*b* of second end 20. As indicated in FIG. 1 of the drawings, side 24 is of a first length "L", while side 26 is of a second length "L+X". For reasons presently to be described, first length "L" is less than second length "L+X".

The apparatus of the present invention also comprises an elongate tubular member 30 that is rotatably connected to end 20 of the generally planar paddle component 16 by means of a threaded screw that functions as the pivot pin 32 (see FIGS. 3 and 4). Tubular member 30 has an open end 30*a* and a closed end 30*b* and is provided with a central aperture 33 that will allow a screw driver to permit interconnection of tubular member 30 with the panel member. A washer 35 is provided between the tubular member and the paddle in a manner indicated in FIG. 4 of the drawings so that the tubular member can be smoothly rotated relative to the paddle in the manner indicated by the phantom lines in FIG. 3. As indicated in FIG. 3A, the plane "P" of open end 30*a*, rather than being perpendicular to the side wall of the tubular member, extends at an angle of approximately 68 degrees with respect thereto.

Also forming a part of the apparatus of the present invention is a practice ball assembly 36 that comprises a first practice golf ball 37 and a second practice golf ball 38. Both the practice golf balls are sized so that they will closely fit within the tubular member 30 and, as indicated in the drawings, are connected by an elongated elastomeric cord 40.

Figure 1A:
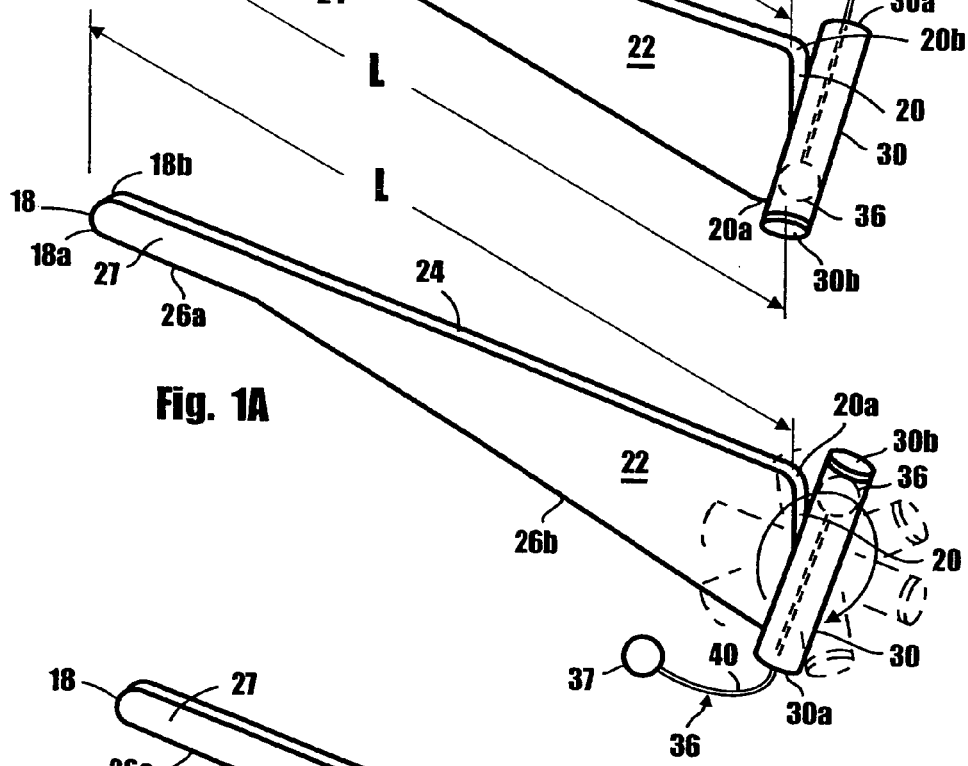
FIG. 1A is a generally perspective view similar to FIG. 1, but showing the apparatus inverted from the position shown in FIG. 1 for practicing the outward swing.
Figure 5:
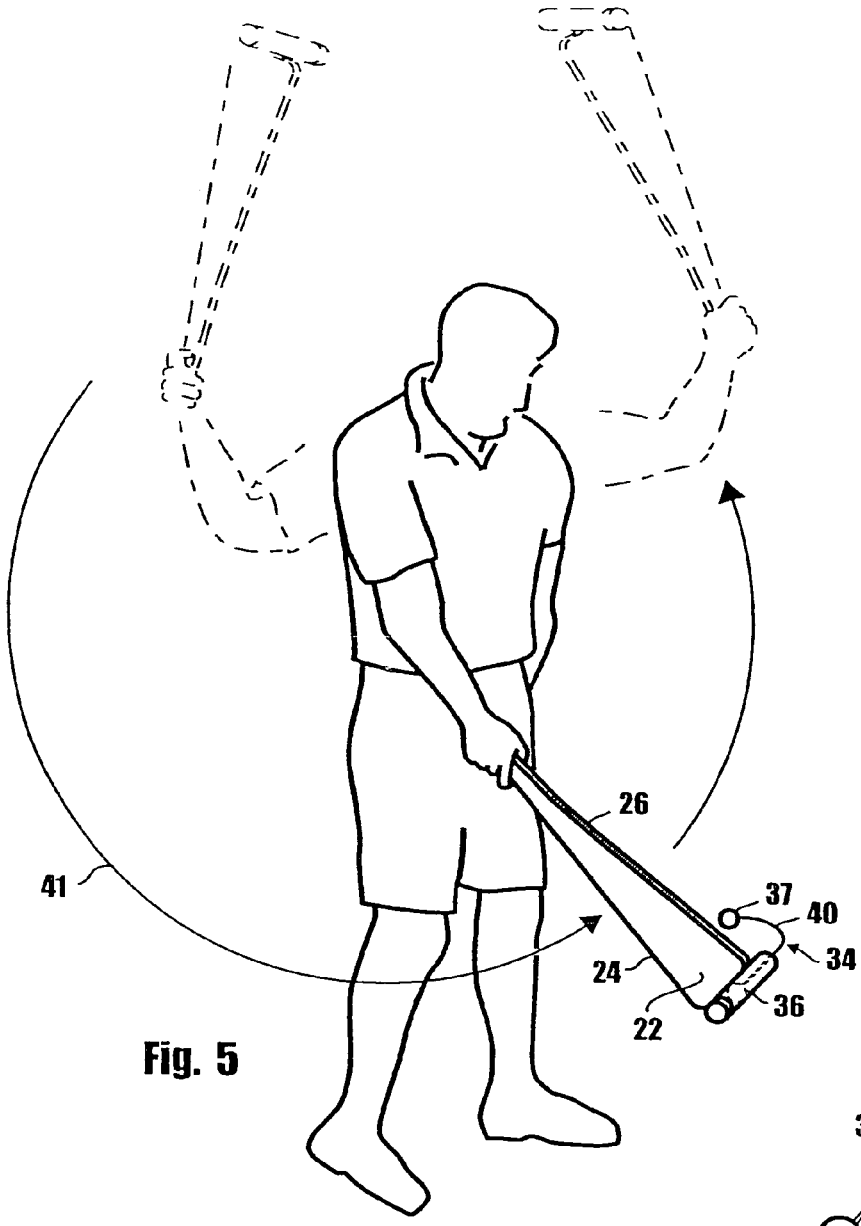
FIG. 5 is a generally perspective view illustrating the use of the apparatus by the trainee to accomplish an inward practice swing.
Figure 5A:
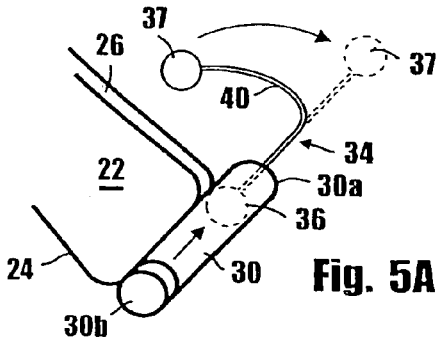
FIG. 5A is a fragmentary perspective view illustrating the path of flight of the practice balls of the practice ball assembly of the invention at the completion of the downward swing.
Figure 5B:
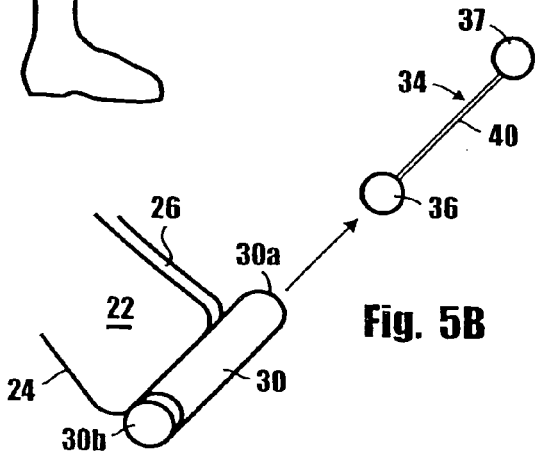
FIG. 5B is a fragmentary perspective view similar to FIG. 5A, further illustrating the path of flight of the practice balls of the practice ball assembly of the invention at the completion of the downward swing.
Figures 6, 6A, 6B, 6C:
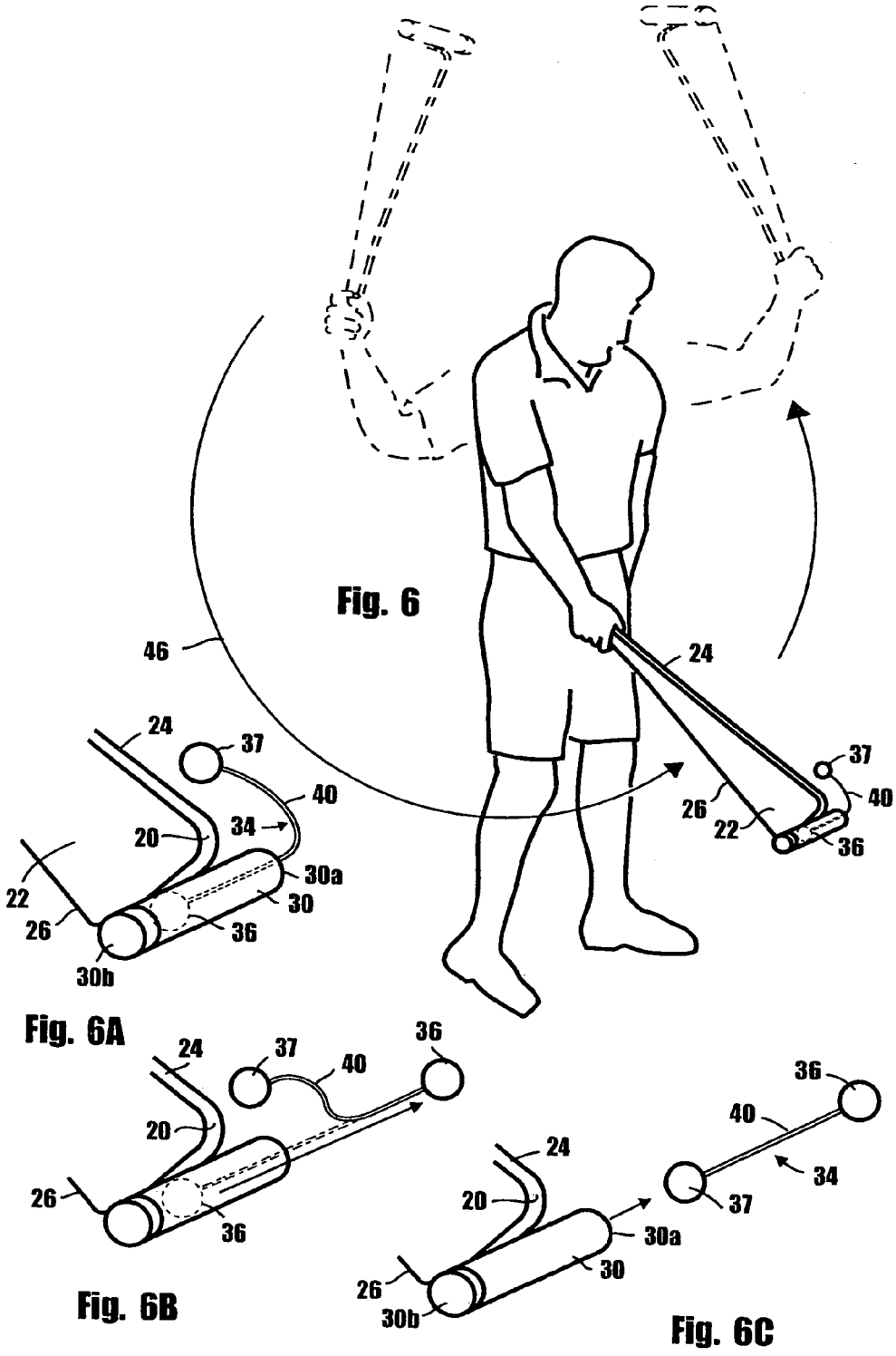
FIG. 6 is a generally perspective view illustrating the use of the apparatus by the trainee in accomplishing an outward practice swing.
FIG. 6A is a fragmentary perspective view illustrating the path of flight of the practice balls of the practice ball assembly of the invention at the completion of the downward swing illustrated in FIG. 6.
FIG. 6B is a fragmentary perspective view, similar to FIG. 6A, further illustrating the path of flight of the practice balls of the practice ball assembly of this latest form of the invention at the completion of the downward swing.
FIG. 6C is a fragmentary perspective view, similar to FIG. 6B, further illustrating the path of flight of the practice balls of the practice ball assembly of this latest form of the invention at the completion of the downward swing.

Turning now to FIG. 5 of the drawings, in using the training apparatus of the invention, one of the practice golf balls such as golf ball 36 is inserted into the open end 30*a* of the tubular member 30, while the second ball 37 is allowed to remain outside the tubular member on the side of the tube farthest away from the trainee. With the practice golf balls in this position, the trainee grips the hand grip portion member 27 with the right hand and moves the apparatus from the starting position shown in the solid lines in FIG. 5 to an upright position shown by the phantom lines in the left-hand portion of FIG. 5. From this position, the trainee starts the downward swing in the manner illustrated by the arrow 41 of FIG. 5. Due to the novel construction of the apparatus of the invention, as the trainee continues the downward swing in a direction toward the starting position, the trainee will experience the feeling of the inward hand action and the practice ball 37 that is on the outward side of the tubular member will be pulled further away from the trainee in the manner indicated by the phantom lines in FIG. 5A and will drag the practice ball 36 out of the tubular member and toward the target in the manner illustrated in FIG. 5B of the drawings. This result is due largely to the fact that because of the unique configuration of the tapered body portion 22 and because the length of side 26 is somewhat greater than the length of side 24, a centrifugal force (outward shaft flex action) is generated during the swing that causes the practice ball assembly 34 to act in the manner described and in the manner illustrated in FIGS. 5A and 5B of the drawings to uniquely simulate the feeling of the inward golf swing. If desired, and in order for the practice ball 36 to more freely exit the tubular member, the tubular member can be rotated in the manner indicated by the phantom lines in FIG. 3 relative to the paddle component into an optimum position In using the training apparatus of the invention to practice the outward golf swing, the paddle component 16 is inverted in the manner illustrated in FIGS. 1A, 2 and 6 of the drawings and the tubular member 30 is rotated approximately 180 degrees relative to the paddle component 16 in the manner illustrated in FIG. 2 of the drawings. This done, one of the practice golf balls, such as golf ball 36, is inserted into the open end 30*a* of the tubular member 30, while the second ball 37 is allowed to remain outside the tubular member on the side closest to the trainee (see also FIG. 2). With the practice golf balls in this position, the trainee grips the hand grip portion member 27 with the right hand and moves the apparatus from the starting position shown in the solid lines in FIG. 6 to an upright position shown by the phantom lines in the left-hand portion of FIG. 6. From this position, the trainee starts the downward swing in the manner illustrated by the arrow 43 of FIG. 6. Due to the novel construction of the apparatus of the invention, as the trainee continues the swing toward the starting position, the trainee will experience the feeling of the outward golf swing and in this instance the practice ball 36 that is inside the tubular member will be propelled forward in the manner illustrated in FIG. 6B of the drawings and will drag the practice ball 37 toward the target in the manner illustrated in FIG. 6C of the drawings. The lag created by this action simulates inward shaft flex action thereby helping to square the club face at impact. As before, this result is due largely to the fact that because of the unique configuration of the body portion 22 which is now inverted into the position shown in FIG. 6 and because the length of side 26 is somewhat greater than the length of side 24, a centrifugal force is generated during the swing that causes the practice ball assembly 34 to act in the manner described herein; as illustrated in FIGS. 6, 6A, 6B and 6C, to uniquely simulate the feeling of outward hand action. As before, if desired, and in order for the practice ball 36 to more freely exit the tubular member, the tubular member can be rotated relative to the paddle in the manner illustrated by the phantom lines in FIG. 3 into an optimum position.

Figures 7, 9:
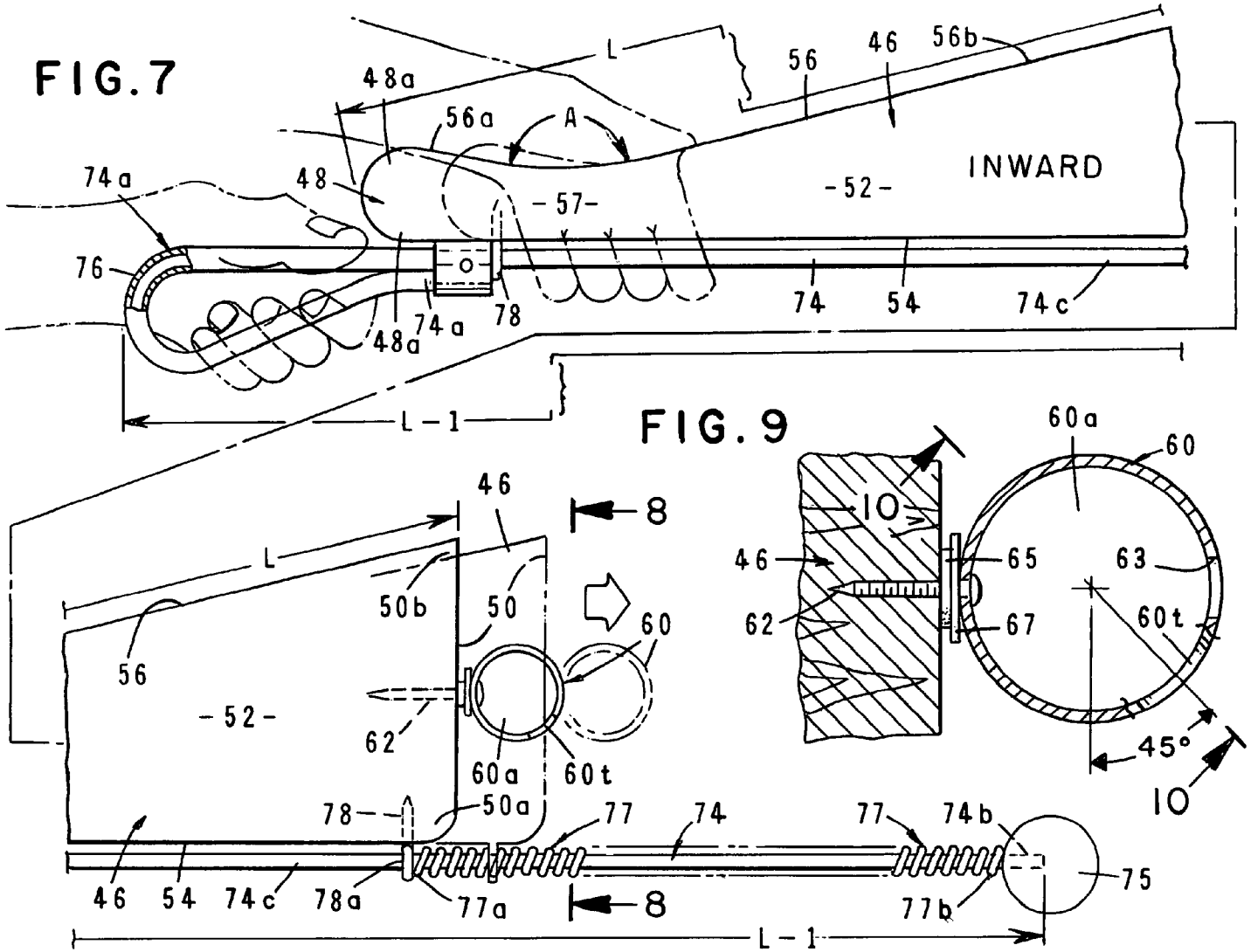
FIG. 7 is a generally diagrammatic side elevational view, partly in cross-section, illustrating the use of an alternate form of the golf training apparatus of the invention for practicing the inward golf swing.
FIG. 9 is a cross-sectional view taken along lines 9-9 of FIG. 8.

Turning next to FIGS. 7 through 11 of the drawings, an alternate form of the golf training apparatus of the invention is there shown and generally identified by the numeral 44. This form of the apparatus, which is similar in some respects to the earlier described embodiment, comprises an elongated, substantially planar paddle component 46 having a first end 48, a second end 50, and a tapered body portion 52 disposed intermediate the first and second ends. As seen in FIG. 7, first end 48 has a first extremity 48*a* and a second extremity 48*b*. Similarly, second end 50 has a first extremity 50*a* and a second extremity 50*b*. Extremities 48*a* and 50*a* are interconnected by a generally straight first side 54, while extremities 48*b* and 50*b* are connected by a second side 56 that is spaced apart from first side 54. Second side 56 has a first segment 56*a*, which along with a portion of first side 54, defines a hand grip portion 57. Second side 56 also includes a second segment 56*b* that extends from said first segment at an obtuse angle "A" (FIG. 7) and interconnects the hand grip portion with extremity 50*b* of second end 50.

Figure 10:
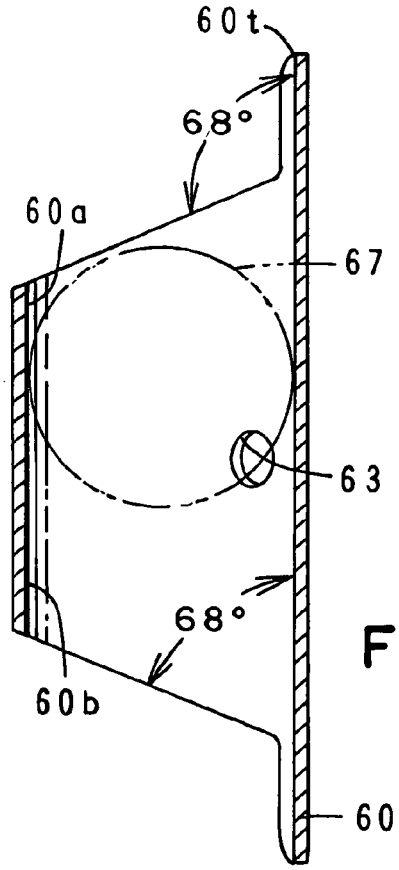
FIG. 10 is a cross-sectional view taken along lines 10-10 of FIG. 9.
Figure 11:
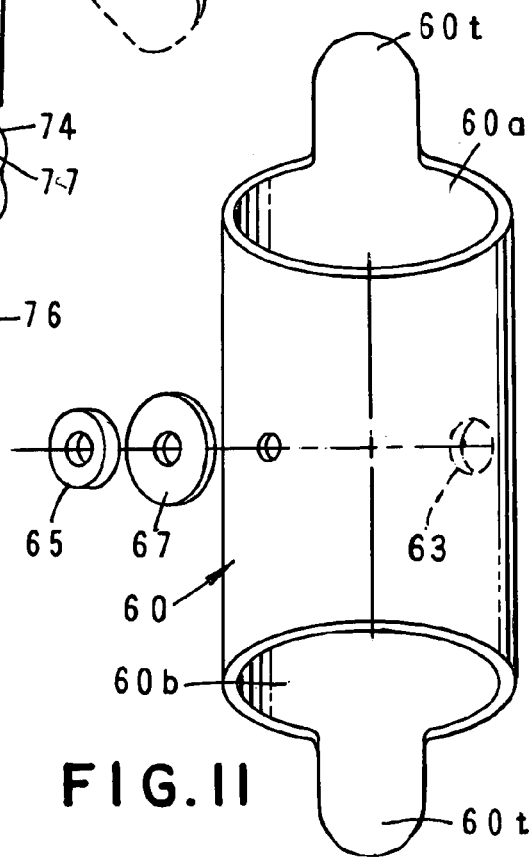
FIG. 11 is a generally perspective, exploded view of the form of the practice ball assembly carrying component of the apparatus of the invention shown in FIG. 7.
Figures 14, 15, 16:
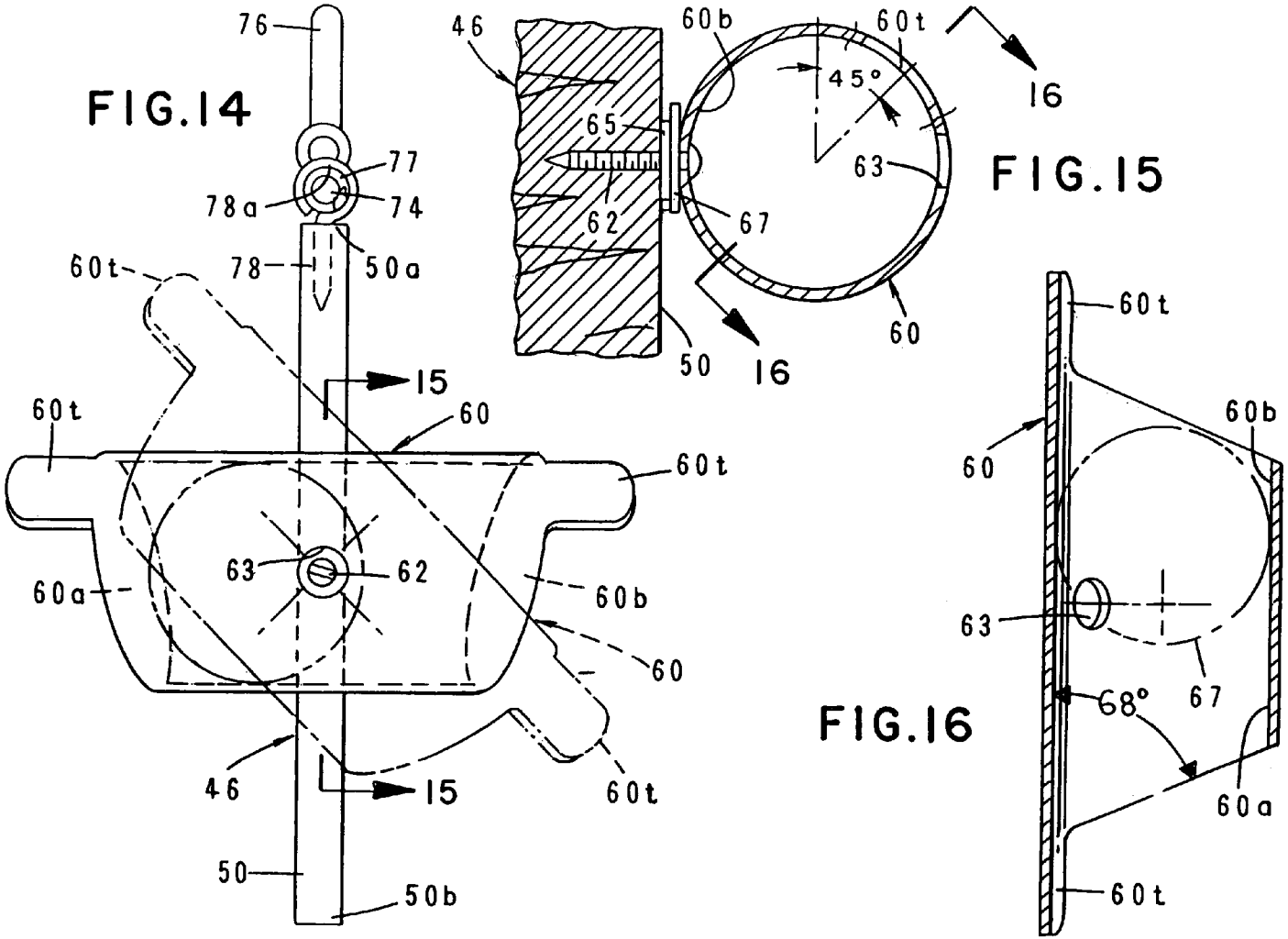
FIG. 14 is an enlarged view taken along lines 14-14 of FIG. 13.
FIG. 15 is a cross-sectional view taken along lines 15-15 of FIG. 14.
FIG. 16 is a cross-sectional view taken along lines 16-16 of FIG. 15.

The apparatus of the present invention also comprises an elongate, generally tubular member 60 that is rotatably connected to end 50 of the paddle component 46 by means of a threaded screw that functions as a pivot pin 62 (see FIG. 9). Tubular member 60 has spaced apart open ends 60*a* and a 60*b* (FIGS. 8 and 11) and is provided with a central aperture 63 that will allow passage of a screw driver shaft to permit interconnection of tubular member 60 with the panel member in the manner shown in FIG. 9. Washers 65 and 67 are provided between the tubular member and the paddle in a manner indicated in FIG. 9 of the drawings so that the tubular member can be smoothly rotated relative to the paddle in the manner indicated by the phantom lines in FIG. 14. As indicated in FIG. 10, the planes of the open ends of the tubular member, rather than being perpendicular to the side wall of the tubular member, extend at an angle of approximately 68 degrees with respect thereto. Outwardly extending extension tabs 60*t* are provided proximate each end of the tubular member 60.

Figure 12:
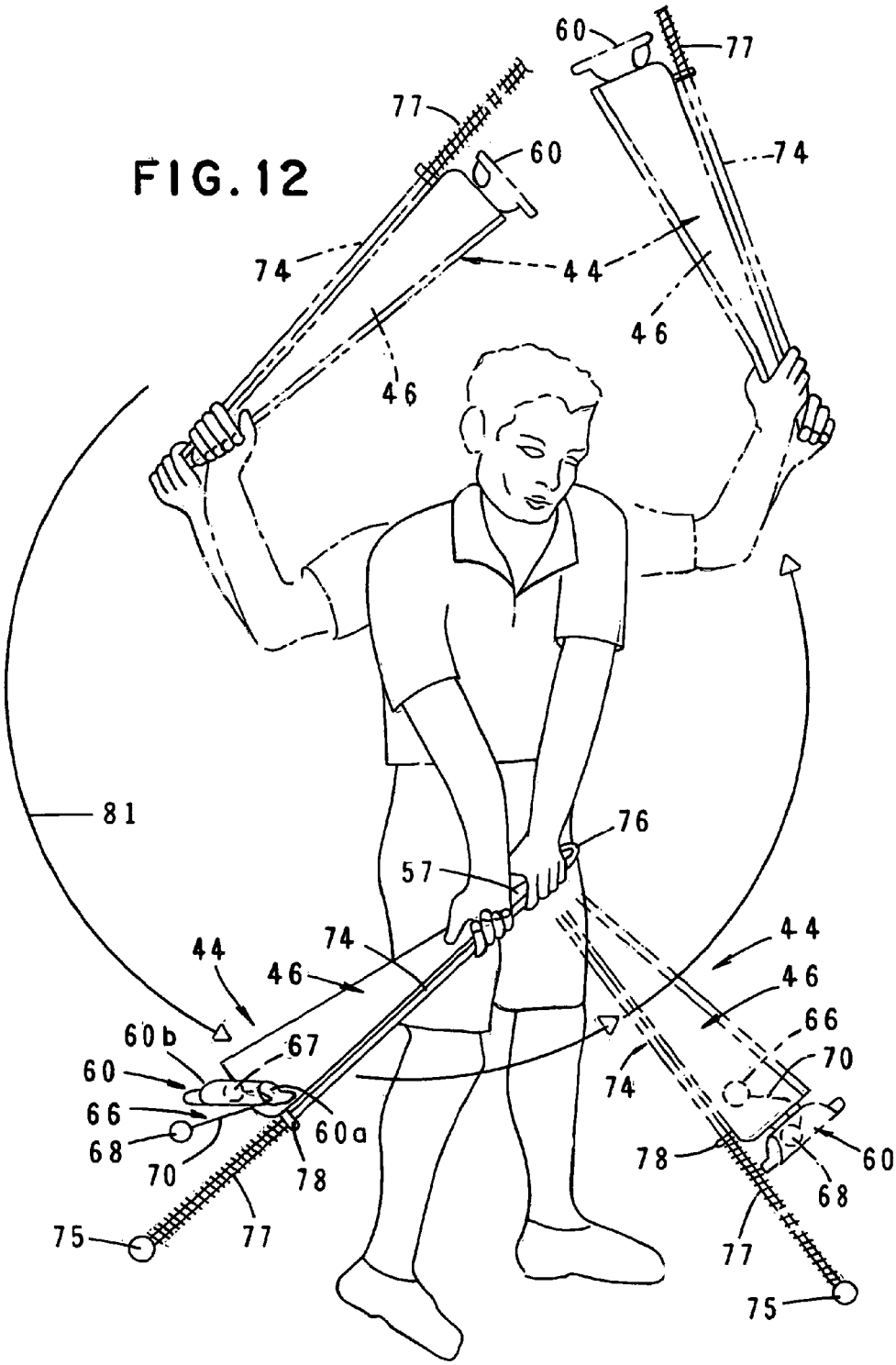
FIG. 12 is a generally perspective view illustrating the use by the trainee of this latest form of the apparatus of the invention to accomplish an inward practice swing.
Figures 12A, 12B:
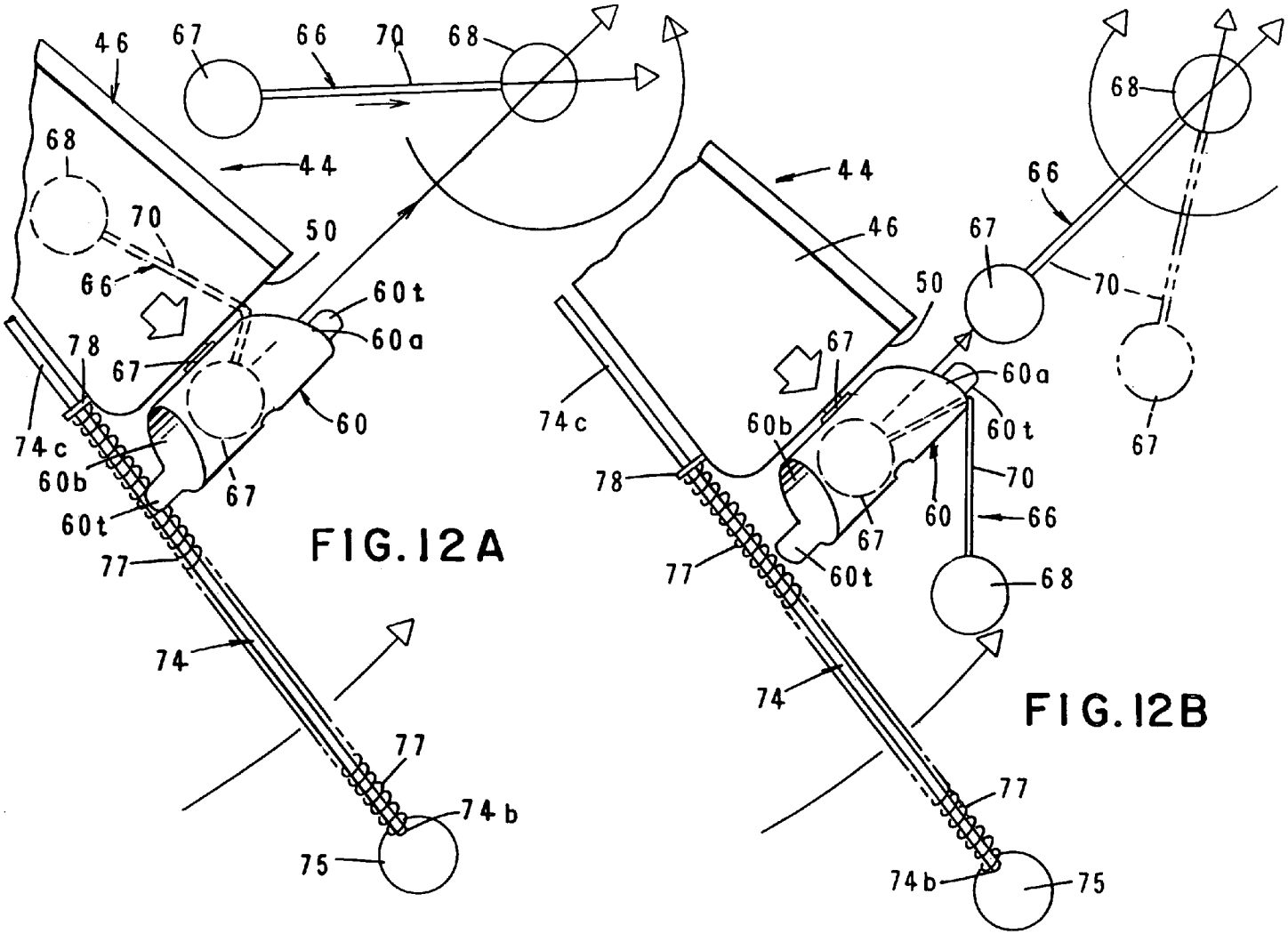
FIG. 12A is a fragmentary, generally perspective view illustrating the path of flight of the practice balls of the practice ball assembly of the invention at the completion of the downward swing.
FIG. 12B is a fragmentary, generally perspective view similar to FIG. 12A, further illustrating the path of flight of the practice balls of the practice ball assembly of the invention at the completion of the downward swing.

Also forming a part of the apparatus of the present invention is a practice ball assembly 66 that comprises a first practice golf ball 67 and a second practice golf ball 68 (FIGS. 12, 12A and 12B). Both of the practice golf balls are sized so that they will closely fit within the tubular member 60 and, as indicated in the drawings, are connected together by an elongated elastomeric cord 70.

The apparatus of this latest form of the invention further uniquely includes an elongated rod 74 having first and second ends 74*a* and 74*b* and a body portion 74*c* disposed intermediate first and second ends 74*a* and 74*b*. As best seen in FIG. 7 of the drawings, first end 74*a* is curved to define a rod hand grip 76. Affixed proximate the second end 74*b* of the rod is a generally spherical member 75 that provides a visual reference point to the trainee during the training swings. As indicated in FIG. 7, generally planar paddle 46 is of a first length "L" and elongated rod 74 is of a second length "L−1", greater than first length "L".

Figure 8:
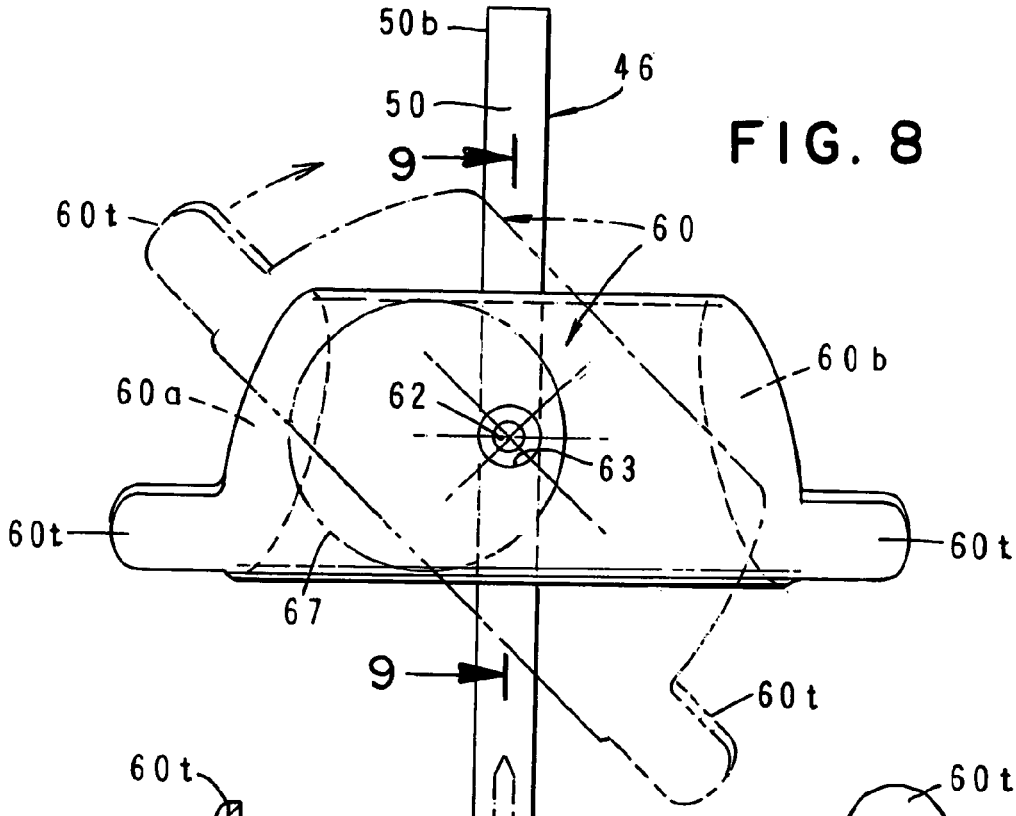
FIG. 8 is an enlarged view taken along lines 8-8 of FIG. 7.

Planar paddle 46 is connected to elongated rod 74 by longitudinally spaced connectors, shown here as screws 78 having eyelets 78*a* that closely receive the body portion 74*c* of the elongated rod (FIGS. 8 and 9). Screws 78 are connected to first side of paddle 48 and extend therefrom in the manner illustrated in the drawings. With the construction shown in the drawings, planar paddle 46 is free to rotate relative to rod 74 between a first position shown in FIG. 7 wherein paddle 46 is above rod 74 and a second position shown in FIG. 13 wherein paddle 46 is below rod 74. During the practice swing, planar paddle 46 is also free to slide longitudinally of rod 74 against the urging of a coil spring 77 between a first retracted position shown by the solid lines in FIG. 7 and a second extended position shown by the phantom lines in FIG. 7. As indicated in FIG. 7, coil spring 77 circumscribes the outer extremity of body portion 74*c* and has a first end 77*a* that is connected to paddle 46 and a second end 77*b* that engages ball 75.

Turning now to FIG. 12 of the drawings, in using the training apparatus of the invention one of the practice golf balls, such as golf ball 67, is inserted into the open end 60*a* of the tubular member 60, while the second ball 68 is allowed to remain outside the tubular member on the side of the tube farthest away from the trainee. With the practice golf balls in this position, using the right hand the trainee grips the paddle grip portion 57 of paddle 46 and using the left hand the trainee grips the rod grip portion 76 of rod 74 (see FIGS. 7 and 12). This done, the inward practice swing can be undertaken in a manner to move the apparatus from the starting position shown in the solid lines in FIG. 12 to an upright position shown by the phantom lines in the left-hand portion of FIG. 12. From this position, the trainee starts the downward swing in the manner illustrated by the arrow 81 of FIG. 12. Due to the novel construction of the apparatus of this latest form of the invention, as the trainee continues the downward swing in a direction toward the starting position, the trainee will experience the feeling of the inward hand action and the practice ball 68 that is on the outward side of the tubular member will be pulled further away from the trainee in the manner indicated by the solid lines in FIG. 12A and will drag the practice ball 67 out of the tubular member and away from the tubular member in a direction toward the target in the manner illustrated in FIG. 12B of the drawings. As before, this result is due largely to the unique configuration of the tapered body portion 52 wherein the length of side 56 is somewhat greater than the length of side 54. With this unique construction a centrifugal force (outward shaft flex action) is generated during the swing that causes the practice ball assembly 64 to act in the manner described and, in the manner illustrated in FIGS. 12A and 12B of the drawings, to uniquely simulate the feeling of the inward golf swing. If desired, and in order for the practice ball 67 to more freely exit the tubular member, the tubular member can be rotated in the manner indicated by the phantom lines in FIG. 14 relative to the paddle component into an optimum position. During the downward swing, paddle 46 will move downward along rod 74 against the urging of spring 77.

Figure 13:
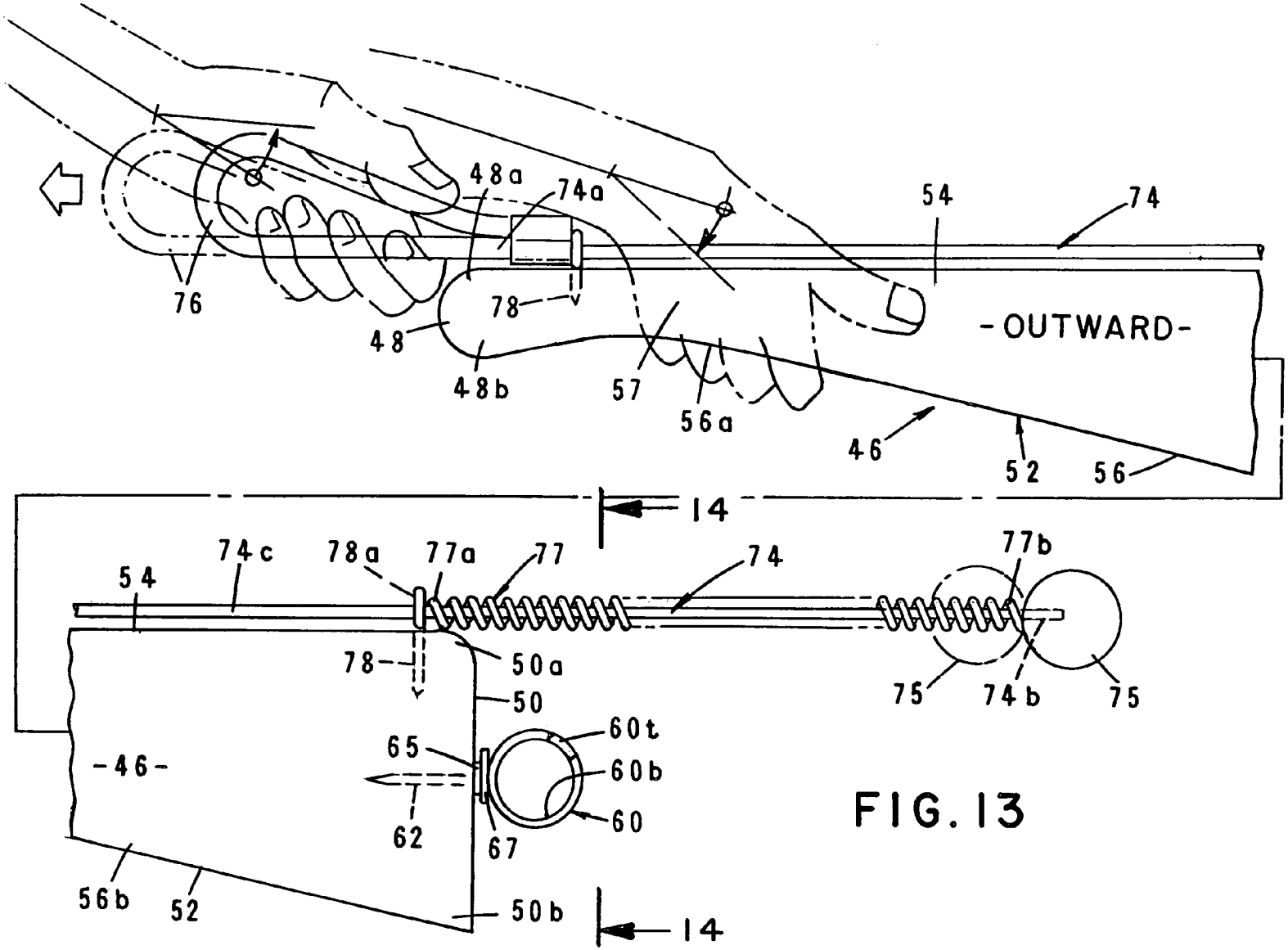
FIG. 13 is a generally diagrammatic, side elevational view, partly in cross-section illustrating the use of the alternate form of the golf training apparatus of the invention for practicing the outward golf swing.
Figure 17:
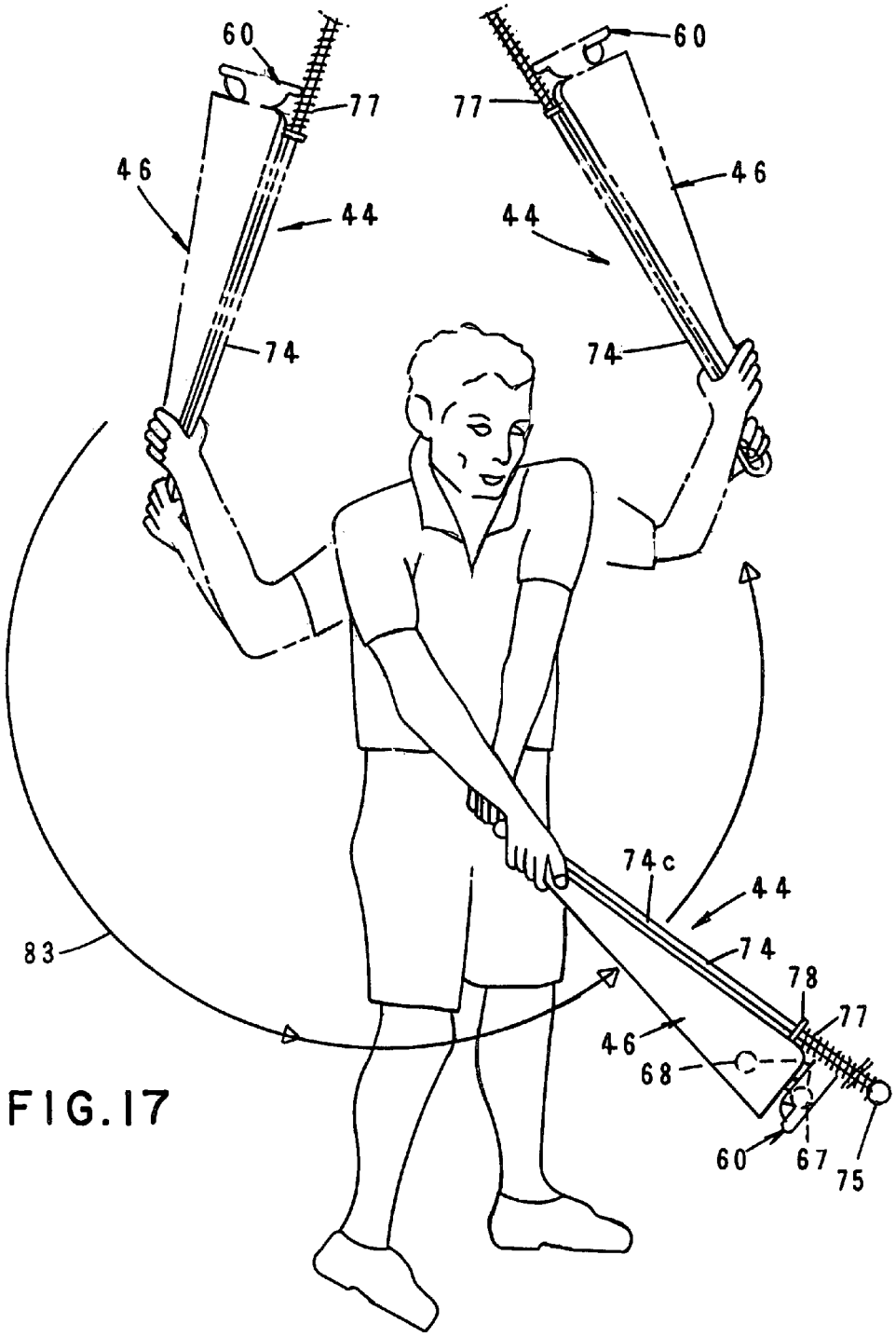
FIG. 17 is a generally perspective view illustrating the use by the trainee of this latest form of the apparatus of the invention to accomplish an outward practice swing.
Figure 18B:
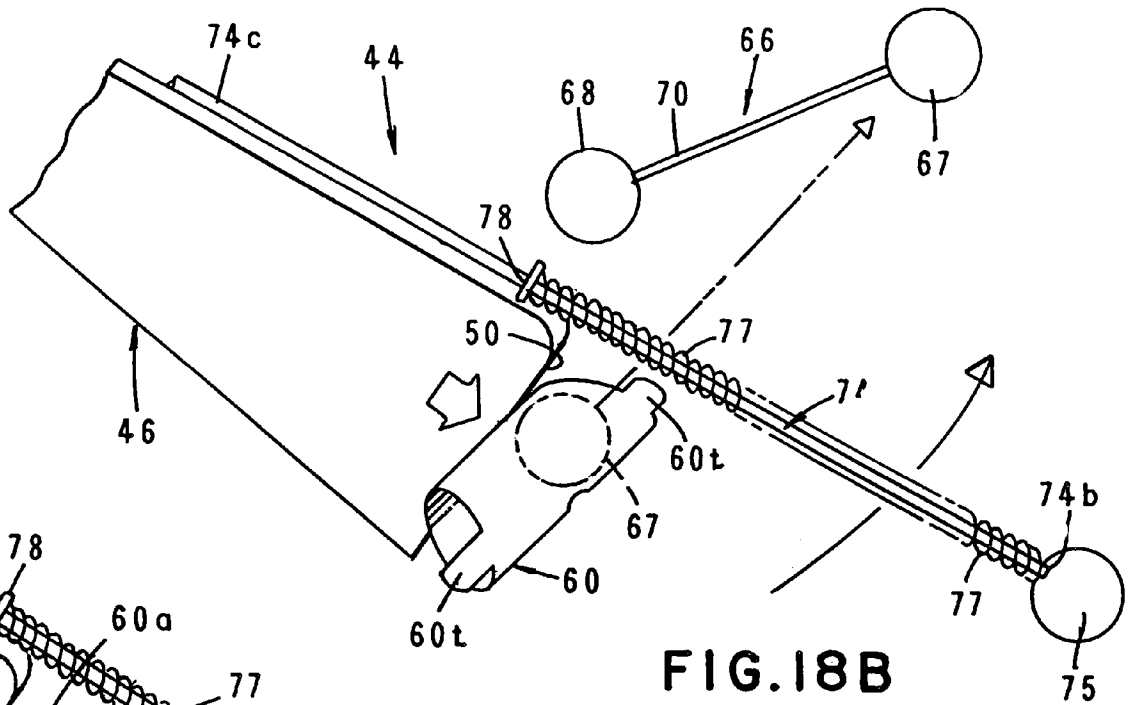
FIG. 18B is a fragmentary perspective view similar to FIG. 18A, further illustrating the path of flight of the practice balls of the practice ball assembly of the invention at the completion of the downward swing.
Figure 18A:
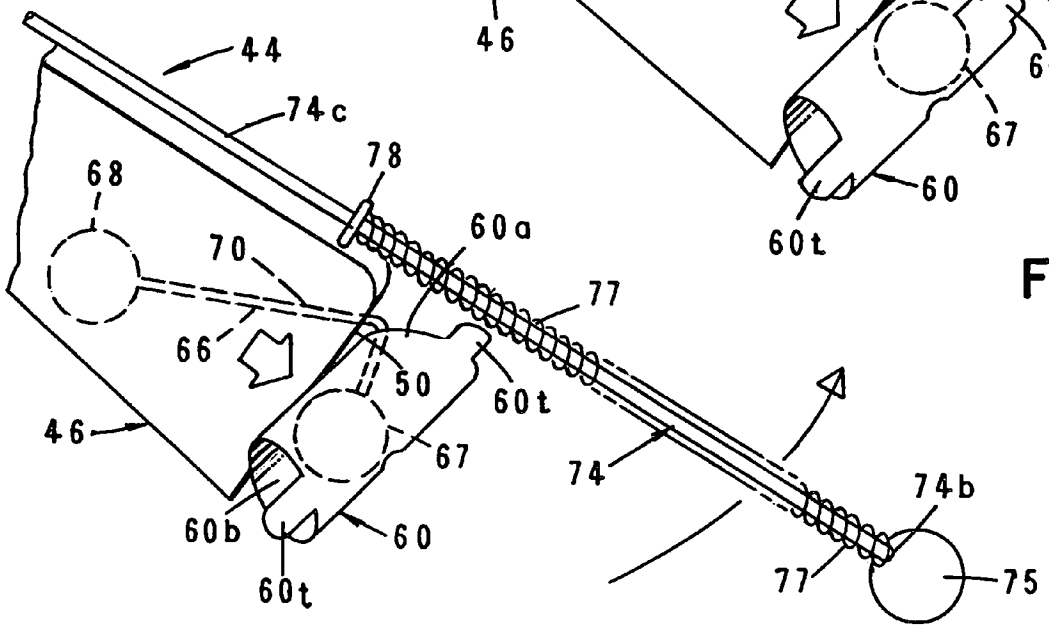
FIG. 18A is a fragmentary perspective view illustrating the path of flight of the practice balls of the practice ball assembly of the invention at the completion of the downward swing.
Figure 18C:
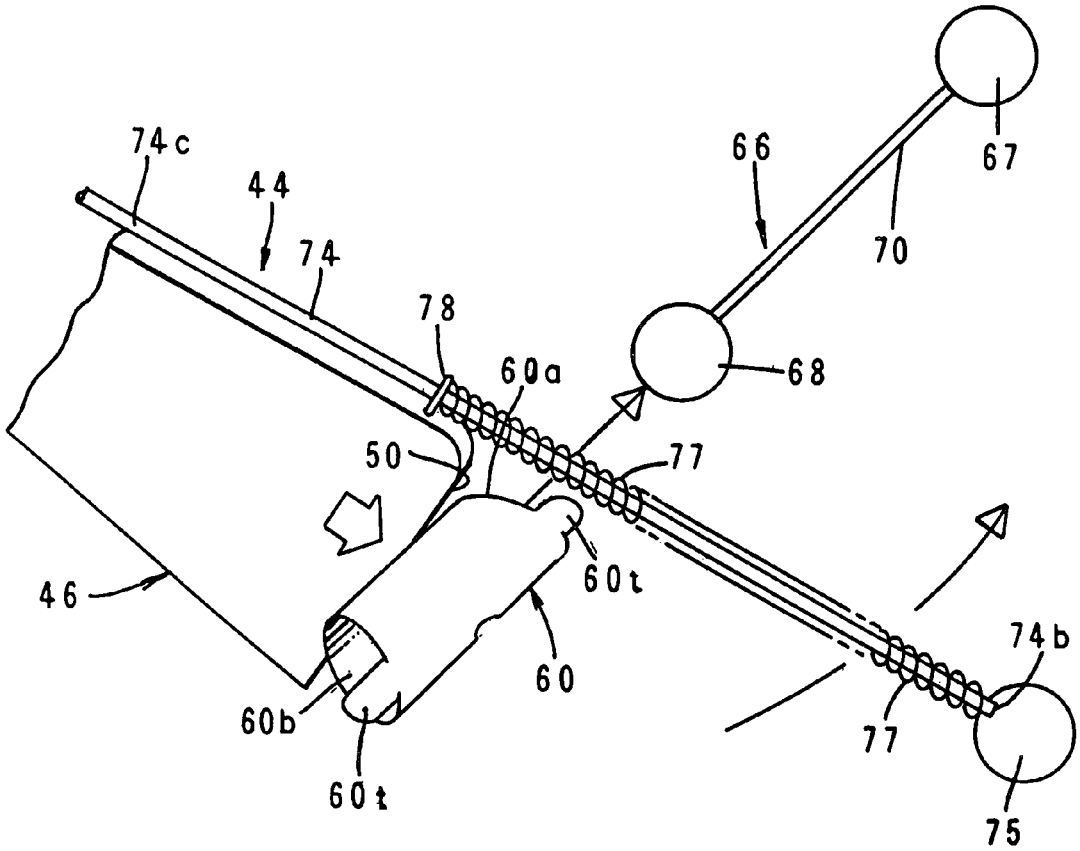
FIG. 18C is a fragmentary perspective view, similar to FIG. 18B, further illustrating the path of flight of the practice balls of the practice ball assembly of this latest form of the invention at the completion of the downward swing.

In using the training apparatus of the invention to practice the outward golf swing, the paddle component 46 is rotated relative to rod 74 into the lowered position illustrated in FIG. 13 of the drawings and the tubular member 60 is rotated in the manner shown in the drawings approximately 180 degrees relative to the paddle component 46. This done, one of the practice golf balls, such as golf ball 67, is inserted into the open end 60*a* of the tubular member 60, while the second ball 67 is allowed to remain outside the tubular member on the side closest to the trainee. With the practice golf balls in this position, using the right hand, the trainee grips the paddle grip portion 57 of paddle 46 and, using the left hand, the trainee grips the rod grip portion 76 of rod 74 (see FIGS. 13 and 17). This done, the outward practice swing can be undertaken in a manner to move the apparatus from the starting position shown in the solid lines in FIG. 17 to an upright position shown by the phantom lines in the left-hand portion of FIG. 17. From this position, the trainee starts the downward swing in the manner illustrated by the arrow 83 of FIG. 17. Due to the novel construction of the apparatus of the invention, as the trainee continues the swing toward the starting position, the trainee will experience the feeling of the outward golf swing and in this instance the practice ball 67 that is inside the tubular member will be propelled forward in the manner illustrated by the sold lines in FIG. 18B of the drawings and will, in turn, propel the practice ball 68 toward the target in the manner illustrated in FIG. 18C of the drawings. The lag created by this action simulates inward shaft flex action thereby helping to square the club face at impact. As before, this result is due largely to the fact that because of the unique configuration of the paddle 46, which is now rotated relative to rod 74 into the position shown in FIG. 13. Because the length of side 56 is somewhat greater than the length of side 54, a centrifugal force is generated during the swing that causes the practice ball assembly 66 to act in the manner described herein and, as illustrated in FIGS. 18A, 18B and 18C, to uniquely simulate the feeling of an outward hand action. If desired, and in order for the practice ball 67 to more freely exit the tubular member, the tubular member can be rotated relative to the paddle in the manner illustrated by the phantom lines in FIG. 14 into an optimum position. As in the earlier described practice swing, during the downward swing the paddle 46 will be urged forward against the urging of spring 77.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A golf training apparatus comprising:

(a) an elongated rod having first and second ends and a body portion disposed intermediate said first and second ends, said body portion having a rod hand grip;

(b) an elongated, generally planar paddle connected to said elongated rod for rotation with respect thereto between a first position and a second position, said generally planar paddle having a first end, a second end and a body portion disposed intermediate said first and second ends, said body portion of said elongated, generally planar paddle having a paddle hand grip;

(c) a tubular member rotatably connected to said second end of said generally planar paddle, said tubular member having a first open end; and (d) a practice ball assembly operably associated with said tubular member, said practice ball assembly comprising a first practice ball, a second practice ball and an elongated cord interconnecting said first and second practice balls, at least one of said first and second practice balls being closely receivable within said tubular member.

2. The apparatus as defined in claim 1 in which said elongated, generally planar paddle is slidably movable relative to said elongated rod between a first position and a second position.

3. The apparatus as defined in claim 2, further including a coil spring circumscribing said body portion of said elongated rod, said coil spring having a first end connected to said generally planar paddle.

4. The apparatus as defined in claim 1 in which said body portion of said generally planar paddle is tapered and has first and second spaced apart edges, said elongated rod connected to said first edge for rotation relative thereto.

5. The apparatus as defined in claim 4, in which said second edge includes a first segment spaced apart from said first edge to form said paddle hand grip.

6. The apparatus as defined in claim 5 in which said second edge includes a second segment connected to and extending from said first segment at an obtuse angle.

7. A golf training apparatus comprising:

(a) an elongated rod having first and second ends and a body portion disposed intermediate said first and second ends, said body portion having a rod hand grip;

(b) an elongated, generally planar paddle connected to said elongated rod for rotation with respect thereto between a first position and a second position and for sliding movement with respect thereto between a first position and a second position, said generally planar paddle having a first end, a second end and a body portion disposed intermediate said first and second ends, said body portion having a paddle hand grip;

(c) a coil spring circumscribing said body portion of said elongated rod, said coil spring having a first end connected to said generally planar paddle;

(d) a tubular member rotatably connected to said second end of said generally planar paddle, said tubular member having a first open end; and (e) a practice ball assembly operably associated with said tubular member, said practice ball assembly comprising a first practice ball, a second practice ball and an elongated cord interconnecting said first and second practice balls, at least one of said first and second practice balls being closely receivable within said tubular member.

8. The apparatus as defined in claim 7 in which said body portion of said generally planar paddle is tapered and has first and second spaced apart edges, said elongated rod connected to said first edge.

9. The apparatus as defined in claim 7 further including a spherical member affixed to said second end of said elongated rod.

10. The apparatus as defined in claim 7 in which said generally planar paddle is of a first length and in which said elongated rod is of a second length greater than said first length.

11. The apparatus as defined in claim 7, in which said second edge includes a first segment spaced apart from said first edge to form said paddle hand grip.

12. The apparatus as defined in claim 11 in which said second edge includes a second segment connected to and extending from said first segment at an obtuse angle.

13. The apparatus as defined in claim 12, further including a pivot pin rotatably connecting said elongated, generally planar paddle to said elongate tubular member.

14. The apparatus as defined in claim 12 in which said elongated cord of said practice ball assembly comprises an elastomeric cord.

15. A method for practicing a golf swing using an apparatus comprising an elongated rod having a rod hand grip; an elongated, generally planar paddle rotatably connected to said elongated rod for rotation with respect thereto between a first position and a second position, said generally planar paddle having a paddle hand grip; a tubular member having an open end rotatably connected to the second end of the generally planar paddle; and a practice ball assembly comprising a first practice ball, a second practice ball and an elongated cord interconnecting the first and second practice balls; said method comprising the steps of:

(a) practicing an inward golf swing by first inserting the first practice ball into the open end of the tubular member and positioning the second practice ball at a location outside the tubular member;

(b) grasping with one hand the rod hand grip of the elongated rod;

(c) rotating the generally planar paddle into the first position;

(d) grasping with the other hand the paddle hand grip of the generally planar paddle;

(e) swinging the elongated rod and the paddle in a rearward, upward direction to a first elevated position; and (f) swinging the elongated rod and the paddle in a forward, downward direction from said first elevated position to a second lowered position to cause the first practice ball to drag the second practice ball from the open end of the tubular member.

16. The method as defined in claim 15, further including the step of practicing the outward golf swing by:

(a) re-inserting the first practice ball into the open end of the tubular member and positioning the second practice ball at a location outside the tubular member;

(b) rotating the generally planar paddle into the second position;

(c) grasping with one hand the rod hand grip of the elongated rod;

(d) rotating the generally planar paddle into the first position;

(e) grasping with the other hand the paddle hand grip of the generally planar paddle;

(f) swinging the elongated rod and the paddle in a rearward, upward direction to a first elevated position; and (g) swinging the elongated rod and the paddle in a forward, downward direction from said first elevated position to a second lowered position to cause the first practice ball to be propelled away from said tubular member and to drag the second practice ball away from said tubular member.

* * * * *